United States Patent [19]

Rothenberger

[11] Patent Number: 4,890,472

[45] Date of Patent: Jan. 2, 1990

[54] FLARING TOOL FOR HOLLOW WORKPIECES

[75] Inventor: Helmut Rothenberger, Wiesenhang, Fed. Rep. of Germany

[73] Assignee: Rothenberger Werkzeugemaschinen GmbH, Frankfurt Am Main, Fed. Rep. of Germany

[21] Appl. No.: 250,351

[22] Filed: Sep. 28, 1988

[30] Foreign Application Priority Data

Sep. 28, 1987 [DE] Fed. Rep. of Germany ..... 3732628

[51] Int. Cl.[4] ..... B21D 39/20

[52] U.S. Cl. ..... 72/393; 74/107

[58] Field of Search ..... 72/393, 452; 74/107

[56] References Cited

U.S. PATENT DOCUMENTS

| | | | |
|---|---|---|---|
| 291,775 | 1/1884 | Rice | 74/107 |
| 1,320,590 | 11/1919 | Waters | 74/107 |
| 1,560,745 | 11/1925 | Walker | 72/452 |
| 2,197,099 | 4/1940 | Dewar | 72/452 |
| 4,034,591 | 7/1977 | Rothenberger | 72/393 |
| 4,276,765 | 7/1981 | Yoneda | 72/452 |
| 4,735,078 | 4/1988 | Wesebaum | 72/393 |

*Primary Examiner*—Lowell A. Larson
*Attorney, Agent, or Firm*—Felfe & Lynch

[57] ABSTRACT

In a flaring tool for hollow, especially hollow-cylindrical, workpieces, a flaring punch is mounted for axial displacement in a tool body and can, by means of a cam on a hand level, be driven out of the tool body against a set of flaring dies fastened to the tool body. To solve the problem of being able to withdraw the flaring dies from the workpiece quickly enough to prevent the workpiece from quickly shrinking on the flaring dies, the flaring punch is coupled to the hand lever by an extractor whose point of engagement with the hand lever is excentric from the fulcrum axis. The extractor consists advantageously of at least one flat link which is journaled at one end on the hand lever and at the other end on the flaring punch.

4 Claims, 2 Drawing Sheets

FLARING TOOL FOR HOLLOW WORKPIECES

BACKGROUND OF THE INVENTION

The invention relates to a flaring tool for hollow, especially hollow cylindrical, workpieces, having a tool body with a bore, a flaring punch mounted for axial displacement therein whose outer tapered end protrudes from the bore, a cam likewise journaled in the tool body on a fulcrum axis perpendicular to the bore axis and operated by a hand lever by which the flaring punch can be displaced by a given amount away from the tool body out of a set of flaring dies that are joined to the tool body.

A flaring tool of this kind is disclosed in U.S. Pat. No. 4,034,591. The flaring punch mounted for displacement in the base tool body can be moved in only one direction by operating the lever, namely in the direction producing a radial outward displacement of the flaring dies. When the hand lever is moved in the opposite direction, the cam lifts away from the flaring punch. Nor can the annular spring associated with the flaring dies push the punch back, since the punch is provided with a very slender tapered end on account of the desire for a low actuating force on the hand lever, so that the system operates close to the taper-locking point. In order therefore to be able to remove the flaring dies from the flared workpiece, the dies must be first loosened by shaking the tool or tapping it. While in the case of metal workpieces, such as copper pipe for example, this method is successful because, after flaring, the material can no longer contract again. Such loosening is impossible in the case of materials which have a tendency to return to their original shape by "creeping." This characteristic is present, for example, in numerous high-strength plastics, such as are used today in plumbing, but especially for so-called "hydronic floor heating." These pipes have a marked shape-recovering ability and recover their shape in very little time, so that in any case it is not easily possible, when using the known flaring tools, to remove the flaring dies from the workpiece in time. Pipes made from plastic tend to shrink onto the flaring dies to a certain extent.

Although a spring to return the flaring punch is described in U.S. Pat. No. 4,034,591, its disposition is limited to a so-called adapter, as provided as a transitional piece in conjunction with relatively large sets of flaring dies. But even a return spring of this kind would not be suitable for solving the problem if it were contained in the tool body. For in the flaring of plastic pipes, the strength of the return spring is not sufficient to bring the punch back to the required end position. On the one hand the action of the spring is limited only to part of the travel of the flaring punch, and on the other hand the spring cannot be made arbitrarily strong since the return force must, of course, be overcome in addition to the flaring force when the tool is operated. Here, too, experience has shown that plastic pipes seize tightly on the flaring dies after the flaring operation, on account of their rapid shrinkage.

It is furthermore known to provide flaring punches for such tools with a positive return by driving them with a threaded spindle. As a rule the threaded spindle is driven by a so-called ratchet. A threaded spindle, however, can perform the reverse movement of the punch only very slowly. If a ratchet is used, its driving direction must also be reversed, or the ratchet must be reversed, so that considerable time passes before the flaring punch has begun, much less completed, its return movement. The result is, again, a seizure of plastic tubes onto the flaring dies.

The known flaring tools have therefore been limited, as a rule to use on metal workpieces. However, as is explained below, there is also a need for a flaring tool which is capable of flaring plastic pipes.

When plastic pipes are used in plumbing, especially in the production of hydronic floor heating systems, sections of finite length of such pipes have to be joined together. This is accomplished with so-called double-ended nipples which are shaped at both ends a serrated profile, as is the known practice in the case of garden hose couplings. Since the inside diameter of these nipples must not be substantially less than the inside diameter of the plastic pipes to be joined, and the nipples must still have sufficient thickness even between the serrations, the ends of the plastic pipes must be correspondingly flared to a depth that corresponds to approximately half the length of the nipple. In making such connections, use is already made of the property of such plastic pipes of shrinking very quickly onto the nipples in an absolutely leak-proof and mechanically strong manner. This shrinking characteristic of the plastic, that is so desirable in producing the bond between the nipple and plastic pipe, is extremely disadvantageous, however, in the case of the flaring operation itself, in that the operator is obliged to work very rapidly and, after flaring the pipe end, must not only remove the flaring tool from the end of the pipe but also insert the one end of the nipple, whose other end, in half of all the cases, is already joined to a long piece of pipe.

On account of the above-described behavior of the materials in question it is also impossible, for example, to prepare a large stock of flared plastic pipes, as would be easily possible in the case of metal pipes, which afterward can be joined together in a water-tight manner only by soldering.

It is therefore the object of the invention to improve a flaring tool of the type described above so that its flaring punch can be extracted from the end of the workpiece within the shortest possible time.

SUMMARY OF THE INVENTION

The above stated object, as well as other objects which will become apparent from the discussion that follows, are accomplished, in accordance with the invention, in the case of the flaring tool described above, in that the flaring punch is coupled to the hand lever by an extractor whose point of attachment to the hand lever is excentric from the fulcrum axis thereof.

In an especially advantageous manner the extractor consists of at least one link which is joined to the hand lever by a first pivot pin and to the flaring punch by a second pivot pin.

With an extractor of this kind the flaring punch can be extracted positively out of the set of flaring dies right at the beginning of the reverse movement of the hand lever, so that the annular spring or springs of the flaring dies are sufficient to return the set of dies back to its minimum outside diameter. Shaking, tapping or knocking on the tool body is thus entirely unnecessary, and the flaring tool can be extracted from the workpiece during the return movement of the hand lever, so that the muff or nipple coupling can be made in an instant. The shrinking in this case will continue even after the nipple is inserted, so that an absolutely tight and mechanically strong, pressure-resistant seal can be achieved.

In one embodiment the cam and the end of the punch facing the cam are provided each with a central slot, the slots being aligned with one another. The ends of the extractor links are journaled in these slots.

In another advantageous embodiment, the cam and the end of the punch facing the cam are defined on both sides of plane-parallel surfaces which are aligned with one another and on which the ends of a pair of links are pivoted.

In both embodiments the central link or the two side links can be integrated into the tool without requiring additional space; i.e., without increasing the external dimension of the tool. Thus the advantages of the known flaring tool are entirely preserved in the subject of the invention.

It is especially advantageous if, when the flaring punch is extended farthest from the tool, the pivot axis of the first pivot pin mounted in the hand lever is on one side of a plane in which the pivot axis of the cam and the axis of the second pivot pin passing through the flaring punch are located.

The axes of the pivot pins and the cam axis are thus situated, when the extracting movement of the punch begins, at the corners of a triangle, so that the return movement begins not, so to speak, from a dead center position with the velocity zero, but with considerable speed, so that the return movement of the flaring dies is released within a minimum of time.

BRIEF DESCRIPTION OF THE DRAWINGS

Two examples of the embodiment of the invention will be further explained below in conjunction with FIGS. 1 to 4, wherein:

FIG. 1 is an axial section through a complete flaring tool having a centrally mounted retractor and a set of flaring dies bolted on.

DESCRIPTION OF THE PREFERRED EMBODIMENTS

Figure 1:
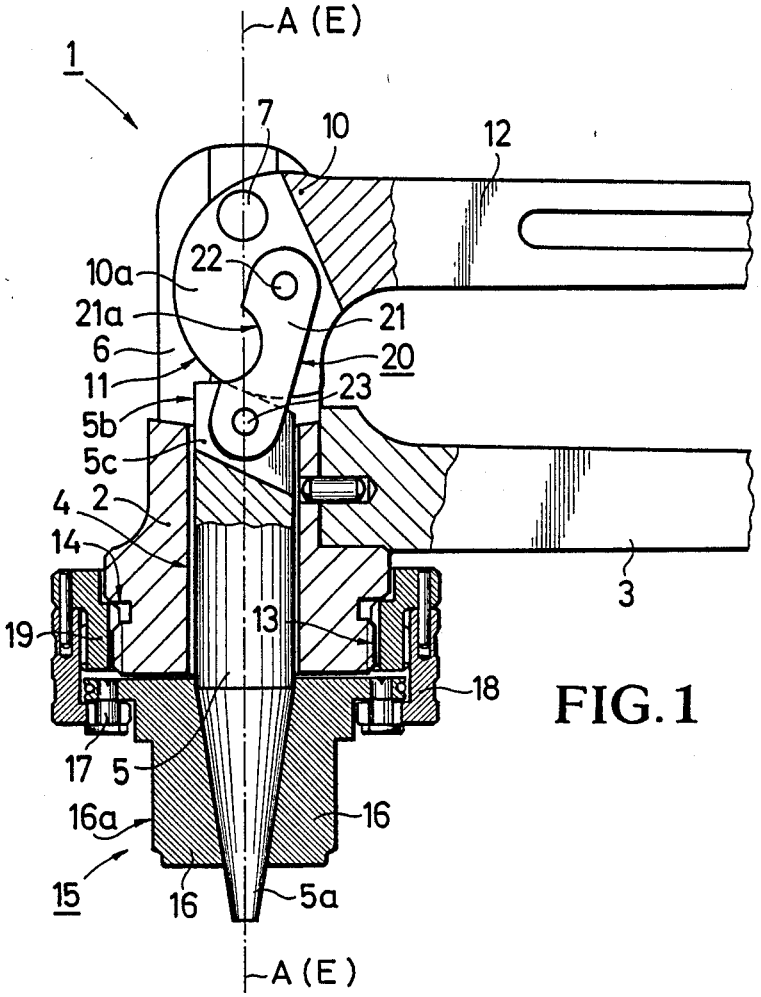
Figure 2:
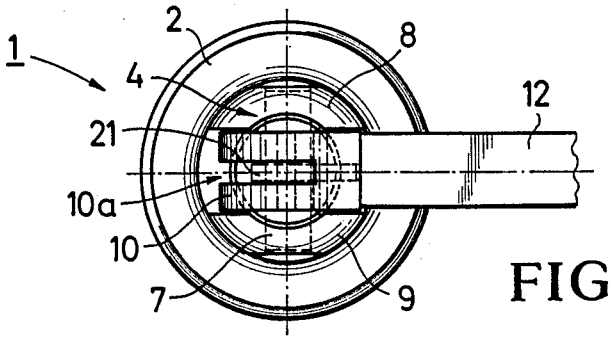
FIG. 2 is a top view of the subject of FIG. 1.

In FIGS. 1 and 2 is shown a flaring tool 1 which has a tool body 2 originally configured as a swivel, to which a radially extending first hand lever 3 is fastened laterally. The tool body 2 has an axis A—A and a linear bore 4 concentric therewith. A flaring punch 5, mounted for axial displacement within the bore, has a conically tapered end 5*a* which protrudes from the tool body 2.

The end of the tool body 2, remote from the tapered end 5*a* of the flaring punch 5 is provided on the other side of an attached hand lever 3, with a parallel-walled slot 6 into which the bore 4 leads. Two cheeks 8 and 9 are left standing on either side of the slot (FIG. 2) which serves as a fulcrum bearing for a second hand lever 12. This hand lever incorporates a cam 10 in the area of the bearing.

The hand lever 12 is journaled on a fulcrum pin 7 in the slot 6, the central axis of the fulcrum pin 7 being perpendicular to and intersecting the axis A—A. The cam 10 has a cam surface 11 excentric to the fulcrum pin 7, which acts on the upper end 5*b* of the flaring punch 5, which is slightly beveled at this point.

The cam 10 is integral with the second hand lever 12 that projects laterally out of the slot 6. Both hand levers 3 and 12 have handles at their extremities not appearing in the drawing, so that they can be operated like tongs with respect to the tool body 2. FIG. 1 shows the two hand levers 3 and 12 in their closest-together position. It can be seen, however, that the second hand lever 12 can be rotated counterclockwise by more than 90 degrees from the position in the drawing, i.e., beyond the axis A—A. The cam surface 11 has a geometric shape with respect to the fulcrum pin 7 that makes due allowance for the flow characteristics of the workpiece and the operating force curve in relation to the angular position of the hand lever 12.

The tool body 2 has, at its end facing the flaring punch 5, a thread 13 and an annular shoulder 14 for the attachment of a set 15 of individual flaring dies 16 that are distributed on the circumference of the flaring punch 5. The flaring dies 16 are held by rivets 16 so as to be radially shiftable in the inside flange of a clamping nut 18 which is screwed through an adapter ring 19 with the thread 13 against the annular shoulder 14. It can be seen by studying FIG. 1 that the so-called working surfaces 16*a* of the flaring die set 16 will be thrust radially outwardly when the tapered end 5*a* is pressed into the flaring dies 16.

The hand lever 12 is now coupled, in accordance with the invention, to the spreading punch 5 by an extractor 20. In the embodiment in FIGS. 1 and 2, this extractor 20 consists of a link 21 which is connected by a first pivot pin 22 to the cam and by a second pivot pin to the flaring punch 5. For this purpose the cam 10 and the end 5*b* of the flaring punch 5 facing the cam 11 are each provided with a central slot-like recess 10*a* and 5*c*, respectively, which are in line with one another, and in which the ends of the link 21 are mounted. Since the link 21 is moved against the pivot pin 7 when the hand lever 12 is near its upper end position, the link 21 has a lateral notch 21*a*, so that the link can accommodate the pivot pin 7 to a certain extent.

Figure 3:
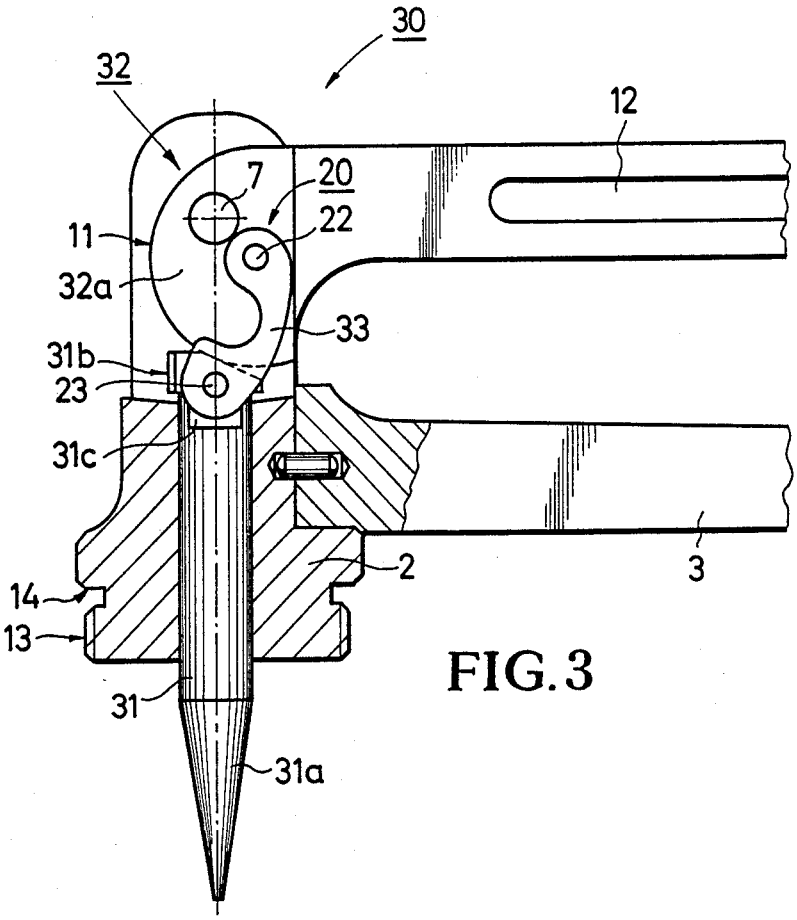
FIG. 3 is a partial axial section through a flaring tool with two lateral retractors, the set of flaring dies being omitted for the sake of clarity.
Figure 4:
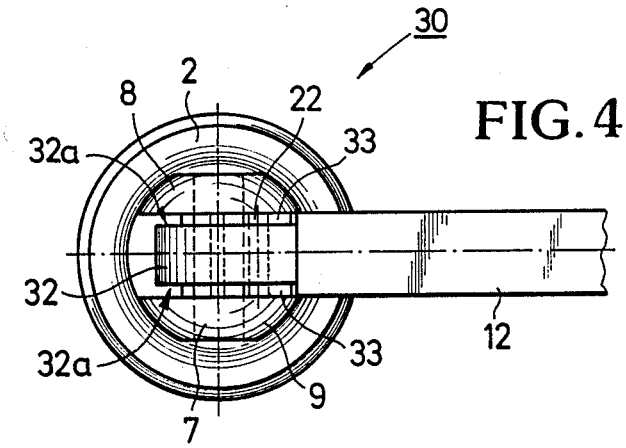
FIG. 4 is a top view of the subject of FIG. 3.

FIG. 3 and 4 show an additional embodiment whose essential elements in regard to claims 1 and 2 are the same as in the embodiment of FIGS. 1 and 2, so that here only the important reference numbers are repeated and the differences will be especially considered.

The flaring tool 30 in accordance with FIGS. 3 and 4 has a flaring punch 31 having a conically tapered end 31*a* and an end 31*b* which faces the cam surface 11. This cam surface 11 is now part of a cam 31 which is journaled in a manner similar to that of FIGS. 1 and 2, but is defined on both sides with clearance by plane-parallel surfaces (FIG. 4). The flaring punch 31 is also defined on confronting sides by two plane-parallel surfaces 31*c*, and the surfaces 31*c* and 32*a* are aligned in pairs with one another. On these surfaces lie also the ends of the paired links 33, which in this case form the extractor 20. The links 33 are similarly journaled by pins 22 and 23 on cam 32 and on the flaring punch 31, respectively.

In both of the embodiments the arrangement is such that the axis of the first pin 22 in cams 10 and 32 will, when the flaring punch is pulled farthest out from the tool body 2, be situated on the hand lever side laterally on one side of plane E—E in which the fulcrum pin 7 of the cams 10 and 32 and the axis of the second pivot pin 23 passing through the flaring punches 5 and 31, respectively, are situated. This special position of the link pins parallel to one another brings it about that the flaring punches 5 and 31 are positively moved at a finite extraction velocity at the very beginning of the return rotation of the hand lever 12. It is to be understood that the position of all linkage points relative to the cam surface 11 is selected such that the links 21 and 33, which are needed only for the positive extraction, are not stressed compressively in the flaring process. Instead, the transfer of pressure is performed exclusively by the cam surface 11.

There has thus been shown and described a novel flaring tool for hollow workpieces which fulfills all the objects and advantages sought therefor. Many changes, modifications, variations and other uses and applications of the subject invention will, however, become apparent to those skilled in the art after considering this specification and the accompanying drawings which discloses the preferred embodiment thereof. All such changes, modifications, variations and other uses and applications which do not depart from the spirit and scope of the invention are deemed to be covered by the invention which is limited only by the claims will follow.

What is claimed is:

1. A flaring tool for hollow, especially cylindrical, workpieces, comprising, in combination:

a tool body with a linear bore;

a flaring punch, mounted for axial displacement in the tool body, having an outer tapered end protruding from the bore;

a set of flaring dies joined to the tool body surrounding the tapered end of the flaring punch;

a cam journaled in the tool body on a fulcrum axis perpendicular to the bore axis and operated by a hand lever to displace the flaring punch by a given amount away from the tool body into the set of flaring dies; and a flaring punch extractor coupling the flaring punch to the hand lever, said extractor comprising a rigid link which is journaled at one end to the flaring punch and at the other end to the hand lever, the point of engagement with the hand lever being excentric from the fulcrum axis, the cam and the end of the flaring punch facing the cam being each provided with a central, slot-like recess in which the ends of the link are guided, the recesses in the cam being in alignment with the recess in the flaring punch.

2. A flaring tool in accordance with claim 1, wherein said point of engagement with the hand lever, when the flaring punch is pushed out of the tool body a maximum distance, lies laterally toward the hand lever with respect to said bore axis.

3. A flaring tool for hollow, especially cylindrical, workpieces, comprising, in combination:

a tool body with a linear bore;

a flaring punch, mounted for axial displacement in the tool body, having an outer tapered end protruding from the bore;

a set of flaring dies joined to the tool body surrounding the tapered end of the flaring punch;

a cam journaled in the tool body on a fulcrum axis perpendicular to the bore axis and operated by a hand lever to displace the flaring punch by a given amount away from the tool body into the set of flaring dies; and a flaring punch extractor coupling the flaring punch to the hand lever, said extractor comprising two rigid links which are both journaled at one end to the flaring punch, and at the other end to the hand lever, the points of engagement with the hand lever being excentric from the fulcrum axis, the cam and the end of the flaring punch facing the cam being each provided with two plane-parallel surfaces on which the ends of the link are guided, the two links being articulated respectively, to the hand lever, and to the flaring punch.

4. A flaring tool in accordance with claim 3, wherein said point of engagement with the hand lever, when the flaring punch is pushed out of the tool body a maximum distance, lies laterally toward the hand lever with respect to said bore axis.

* * * * *

UNITED STATES PATENT AND TRADEMARK OFFICE

CERTIFICATE OF CORRECTION

PATENT NO. : 4,890,472

DATED : January 2, 1990

INVENTOR(S) : Helmut Rothenberger

It is certified that error appears in the above-identified patent and that said Letters Patent is hereby corrected as shown below:

Column 6, line 4 for "recesses" read -- recess --.

[57] Abstract, line 4 for "level" read -- lever --.

Signed and Sealed this

First Day of September, 1992

*Attest:*

DOUGLAS B. COMER

*Attesting Officer*

*Acting Commissioner of Patents and Trademarks*